US011619957B2

(12) United States Patent
Khlat et al.

(10) Patent No.: US 11,619,957 B2
(45) Date of Patent: Apr. 4, 2023

(54) POWER MANAGEMENT CIRCUIT OPERABLE TO REDUCE ENERGY LOSS

(71) Applicant: Qorvo US, Inc., Greensboro, NC (US)

(72) Inventors: Nadim Khlat, Cugnaux (FR); Michael R. Kay, Summerfield, NC (US)

(73) Assignee: Qorvo US, Inc., Greensboro, NC (US)

( * ) Notice: Subject to any disclaimer, the term of this patent is extended or adjusted under 35 U.S.C. 154(b) by 0 days.

(21) Appl. No.: 17/325,482

(22) Filed: May 20, 2021

(65) Prior Publication Data

US 2022/0057820 A1 Feb. 24, 2022

Related U.S. Application Data

(60) Provisional application No. 63/067,076, filed on Aug. 18, 2020.

(51) Int. Cl.
*G05F 1/46* (2006.01)

(52) U.S. Cl.
CPC ..... *G05F 1/46* (2013.01)

(58) Field of Classification Search
None
See application file for complete search history.

(56) References Cited

U.S. PATENT DOCUMENTS 7,859,338 B2 12/2010 Bajdechi et al.
8,159,309 B1 4/2012 Khlat et al.
8,718,188 B2 5/2014 Balteanu et al.
9,020,453 B2 4/2015 Briffa et al.
9,069,365 B2 * 6/2015 Brown ..... H02M 3/156
(Continued)

FOREIGN PATENT DOCUMENTS

DE 102019218816 A1 6/2020
WO 2018187245 A1 10/2018
WO 2021016350 A1 1/2021

OTHER PUBLICATIONS

Mellon, L., "Data Transmission—Parallel vs Serial," Jul. 10, 2017, https://www.quantil.com/content-delivery-insights/content-acceleration/data-transmission/, 4 pages.
(Continued)

*Primary Examiner* — Thomas J. Hiltunen
(74) *Attorney, Agent, or Firm* — Withrow & Terranova, P.L.L.C.

(57) ABSTRACT

A power management circuit operable to reduce energy loss is provided. The power management circuit is configured to provide a time-variant voltage(s) to a power amplifier(s) for amplifying an analog signal(s). To achieve best possible operating efficiency at the power amplifier(s), the time-variant voltage(s) needs to rise and fall frequently and quickly in accordance with power fluctuations of the analog signal(s). The power management circuit stores an electrical potential energy (e.g., capacitive energy) when the time-variant voltage(s) increases and discharges the electrical potential energy when the time-variant voltage(s) decreases. In embodiments disclosed herein, the power management circuit is configured to harvest a portion of the discharged electrical potential energy to thereby charge a battery. By harvesting the discharged electrical potential energy, it is possible to prolong battery life concurrent to supporting fast and frequent voltage changes.

19 Claims, 4 Drawing Sheets

(56) References Cited

U.S. PATENT DOCUMENTS

| | | | | |
|---|---|---|---|---|
| 9,148,090 | B2 * | 9/2015 | Tsuji | H03F 1/02 |
| 9,172,331 | B2 | 10/2015 | Nagasaku et al. | |
| 9,231,527 | B2 | 1/2016 | Hur et al. | |
| 9,350,299 | B2 * | 5/2016 | Tsuji | H03F 1/0261 |
| 9,356,760 | B2 | 5/2016 | Larsson et al. | |
| 9,391,567 | B2 | 7/2016 | Kaczman | |
| 9,407,476 | B2 * | 8/2016 | Lim | H03F 3/24 |
| 9,496,828 | B2 | 11/2016 | Ye | |
| 9,560,595 | B2 | 1/2017 | Dakshinamurthy et al. | |
| 9,614,477 | B1 * | 4/2017 | Rozenblit | H03F 3/68 |
| 9,634,560 | B2 * | 4/2017 | Ek | H02M 3/07 |
| 10,097,145 | B1 | 10/2018 | Khlat et al. | |
| 10,103,926 | B1 | 10/2018 | Khlat | |
| 10,142,074 | B2 | 11/2018 | Wang et al. | |
| 10,243,524 | B2 | 3/2019 | Orr | |
| 10,476,437 | B2 | 11/2019 | Nag et al. | |
| 10,778,094 | B2 | 9/2020 | de Cremoux | |
| 10,862,428 | B2 | 12/2020 | Henzler et al. | |
| 10,998,859 | B2 | 5/2021 | Khlat | |
| 11,018,627 | B2 | 5/2021 | Khlat | |
| 11,018,638 | B2 | 5/2021 | Khlat et al. | |
| 11,088,660 | B2 | 8/2021 | Lin et al. | |
| 11,223,325 | B2 | 1/2022 | Drogi et al. | |
| 11,569,783 | B2 | 1/2023 | Nomiyama et al. | |
| 2003/0099230 | A1 | 5/2003 | Wenk | |
| 2004/0179382 | A1 | 9/2004 | Thaker et al. | |
| 2013/0141063 | A1 | 6/2013 | Kay et al. | |
| 2013/0141068 | A1 | 6/2013 | Kay et al. | |
| 2014/0055197 | A1 | 2/2014 | Khlat et al. | |
| 2014/0097895 | A1 | 4/2014 | Khlat et al. | |
| 2014/0312710 | A1 | 10/2014 | Li | |
| 2014/0315504 | A1 | 10/2014 | Sakai et al. | |
| 2016/0094192 | A1 | 3/2016 | Khesbak et al. | |
| 2016/0294587 | A1 | 10/2016 | Jiang et al. | |
| 2017/0331433 | A1 | 11/2017 | Khlat | |
| 2018/0234011 | A1 | 8/2018 | Muramatsu et al. | |
| 2018/0257496 | A1 * | 9/2018 | Andoh | H02J 7/0029 |
| 2018/0278213 | A1 | 9/2018 | Henzler et al. | |
| 2018/0351454 | A1 | 12/2018 | Khesbak et al. | |
| 2019/0068234 | A1 | 2/2019 | Khlat et al. | |
| 2019/0109566 | A1 * | 4/2019 | Folkmann | H03F 3/19 |
| 2019/0181813 | A1 | 6/2019 | Maxim et al. | |
| 2019/0222175 | A1 | 7/2019 | Khlat et al. | |
| 2019/0288645 | A1 | 9/2019 | Nag et al. | |
| 2019/0334750 | A1 | 10/2019 | Nomiyama et al. | |
| 2019/0356285 | A1 | 11/2019 | Khlat et al. | |
| 2020/0076297 | A1 | 3/2020 | Nag et al. | |
| 2020/0127612 | A1 | 4/2020 | Khlat et al. | |
| 2020/0136575 | A1 | 4/2020 | Khlat et al. | |
| 2020/0204422 | A1 | 6/2020 | Khlat | |
| 2020/0212796 | A1 | 7/2020 | Murphy et al. | |
| 2020/0266766 | A1 | 8/2020 | Khlat et al. | |
| 2020/0295708 | A1 | 9/2020 | Khlat | |
| 2020/0321917 | A1 | 10/2020 | Nomiyama et al. | |
| 2020/0336105 | A1 | 10/2020 | Khlat | |
| 2020/0336111 | A1 | 10/2020 | Khlat | |
| 2020/0389132 | A1 | 12/2020 | Khlat et al. | |
| 2021/0036604 | A1 | 2/2021 | Khlat et al. | |
| 2021/0126599 | A1 | 4/2021 | Khlat et al. | |
| 2021/0175798 | A1 * | 6/2021 | Liang | H03F 3/2178 |
| 2021/0184708 | A1 | 6/2021 | Khlat | |
| 2021/0226585 | A1 | 7/2021 | Khlat | |
| 2021/0257971 | A1 | 8/2021 | Kim et al. | |
| 2021/0265953 | A1 | 8/2021 | Khlat | |
| 2022/0021302 | A1 | 1/2022 | Khlat et al. | |
| 2022/0029614 | A1 | 1/2022 | Khlat | |
| 2022/0037982 | A1 | 2/2022 | Khlat et al. | |
| 2022/0052655 | A1 | 2/2022 | Khalt | |
| 2022/0066487 | A1 | 3/2022 | Khlat | |
| 2022/0069788 | A1 | 3/2022 | King et al. | |
| 2022/0123744 | A1 | 4/2022 | Khlat | |
| 2022/0271714 | A1 | 8/2022 | Khlat | |

OTHER PUBLICATIONS

Non-Final Office Action for U.S. Appl. No. 17/237,244, dated Sep. 20, 2021, 14 pages.
Non-Final Office Action for U.S. Appl. No. 17/315,652, dated Sep. 2, 2021, 7 pages.
Notice of Allowance for U.S. Appl. No. 17/237,244, dated Jan. 27, 2022, 8 pages.
Non-Final Office Action for U.S. Appl. No. 17/315,652, dated Feb. 14, 2022, 12 pages.
International Search Report and Written Opinion for International Patent Application No. PCT/US2021/061721, dated Mar. 14, 2022, 13 pages.
International Search Report and Written Opinion for International Patent Application No. PCT/US2021/044596, dated Apr. 21, 2022, 13 pages.
Written Opinion for International Patent Application No. PCT/US2021/044596, dated Jun. 10, 2022, 6 pages.
International Preliminary Report on Patentability for International Patent Application No. PCT/US2021/044596, dated Sep. 1, 2022, 19 pages.
Notice of Allowance for U.S. Appl. No. 17/182,539, dated Sep. 14, 2022, 7 pages.
Notice of Allowance for U.S. Appl. No. 17/217,654, dated Oct. 12, 2022, 8 pages.
Notice of Allowance for U.S. Appl. No. 17/218,904, dated Aug. 26, 2022, 9 pages.
Non-Final Office Action for U.S. Appl. No. 17/408,899, dated Aug. 29, 2022, 13 pages.
Written Opinion for International Patent Application No. PCT/US2021/061721, dated Sep. 9, 2022, 7 pages.
Non-Final Office Action for U.S. Appl. No. 17/217,654, dated Jul. 1, 2022, 9 pages.
Non-Final Office Action for U.S. Appl. No. 17/218,904, dated May 25, 2022, 14 pages.
Notice of Allowance for U.S. Appl. No. 17/315,652, dated Jun. 20, 2022, 8 pages.
Final Office Action for U.S. Appl. No. 17/408,899, dated Dec. 27, 2022, 13 pages.
Notice of Allowance for U.S. Appl. No. 17/408,899, dated Feb. 24, 2023, 9 pages.
Non-Final Office Action for U.S. Appl. No. 17/942,472, dated Feb. 16, 2023, 13 pages.
Paek, J.S. et al., "15.2 A 90ns/V Fast-Transition Symbol-Power-Tracking Buck Converter for 5G mm-Wave Phased-Array Transceiver," 2019 IEEE International Solid-State Circuits Conference, Feb. 2019, San Francisco, CA, USA, IEEE, 3 pages.
Written Opinion for International Patent Application No. PCT/US2021/061721, dated Mar. 1, 2023, 7 pages.
Extended European Search Report for European Patent Application No. 22200300.6, dated Feb. 24, 2023, 10 pages.

* cited by examiner

POWER MANAGEMENT CIRCUIT OPERABLE TO REDUCE ENERGY LOSS

RELATED APPLICATIONS

This application claims the benefit of provisional patent application Ser. No. 63/067,076, filed Aug. 18, 2020, the disclosure of which is hereby incorporated herein by reference in its entirety.

FIELD OF THE DISCLOSURE

The technology of the disclosure relates generally to a power management circuit, particularly a power management circuit operable to reduce energy loss during operation.

BACKGROUND

Fifth-generation (5G) new radio (NR) (5G-NR) has been widely regarded as the next generation of wide-area wireless communication technology beyond the current third-generation (3G) and fourth-generation (4G) technologies. In this regard, a wireless communication device capable of supporting the 5G-NR wireless communication technology is expected to achieve higher data rates, improved coverage range, enhanced signaling efficiency, and reduced latency across a wide range of radio frequency (RF) bands, which include a low-band (below 1 GHz), a mid-band (1 GHz to 6 GHz), and a high-band (above 24 GHz). Moreover, the wireless communication device may still support the legacy 3G and 4G technologies for backward compatibility.

In addition, the wireless communication device is also required to support local area networking technologies, such as Wi-Fi, in both 2.4 GHz and 5 GHz bands. The latest 802.11ax standard has introduced a dynamic power control feature to allow the wireless communication device to transmit a Wi-Fi signal with a maximum power ranging from −10 dBm to 23 dBm. Accordingly, a Wi-Fi power amplifier(s) in the wireless communication device must be able to adapt a power level of the Wi-Fi signal on a per-frame basis. As a result, a power management circuit must be able to adapt an average power tracking (APT) voltage supplied to the Wi-Fi power amplifier(s) within Wi-Fi inter-frame spacing (IFS) to help maintain linearity and efficiency of the Wi-Fi power amplifier(s).

The Wi-Fi IFS may only last sixteen microseconds (16 μs). Depending on specific configurations of the Wi-Fi system, such as bandwidth mode, trigger frame format, modulation and coding scheme (MCS), and delays associated with Wi-Fi physical layer (PHY) and communication buses, the actual temporal limit for the power management circuit to adapt the APT voltage(s) may be as short as one-half of a microsecond (0.5 μs). In this regard, it is desirable for the power management circuit to adapt the APT voltage(s) from one level to another within a defined temporal limit (e.g., 0.5 μs). Furthermore, the wireless communication device may also support such internet-of-things (IoT) applications as keyless car entry, remote garage door opening, contactless payment, mobile boarding pass, and so on. Needless to say, the wireless communication device must also always make 911/E911 service accessible under emergency situations. As such, it is critical that the wireless communication device remains operable whenever needed.

Notably, the wireless communication device relies on a battery cell (e.g., Li-Ion battery) to power its operations and services. Despite recent advancement in battery technologies, the wireless communication device can run into a low battery situation from time to time. In this regard, it is desirable to prolong battery life concurrent to enabling fast APT voltage changes in the wireless communication device.

SUMMARY

Embodiments of the disclosure relate to a power management circuit operable to reduce energy loss. The power management circuit is configured to provide a time-variant voltage(s) to a power amplifier(s) for amplifying an analog signal(s). To achieve the best possible operating efficiency at the power amplifier(s), the time-variant voltage(s) needs to rise and fall frequently and quickly in accordance with power fluctuations of the analog signal(s). The power management circuit stores an electrical potential energy (e.g., capacitive energy) when the time-variant voltage(s) increases and discharges the electrical potential energy when the time-variant voltage(s) decreases. In embodiments disclosed herein, the power management circuit is configured to harvest a portion of the discharged electrical potential energy to thereby charge a battery. By harvesting the discharged electrical potential energy, it is possible to prolong battery life concurrent to supporting fast and frequent voltage changes.

In one aspect, a power management circuit is provided. The power management circuit includes a voltage circuit configured to generate a time-variant voltage at a voltage output based on a battery voltage. The power management circuit also includes a control circuit. The control circuit is configured to determine that the time-variant voltage will decrease from a higher voltage level to a lower voltage level. The control circuit is also configured to cause the voltage circuit to harvest an electrical potential energy discharged when the time-variant voltage decreases from the higher voltage level to the lower voltage level.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 2:
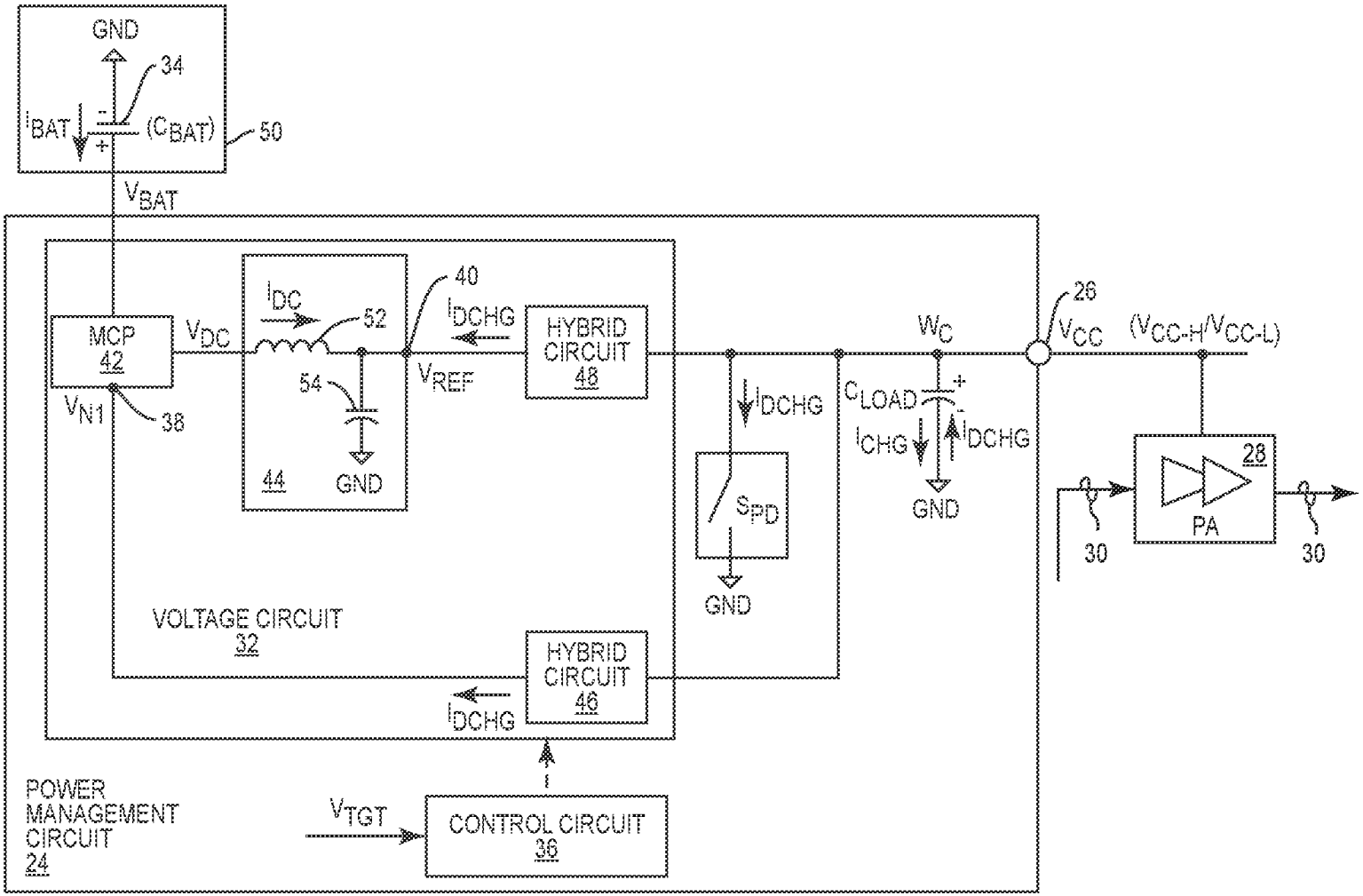
FIG. 2 is a schematic diagram of an exemplary power management circuit configured according to embodiments of the present disclosure to reduce energy loss when switching a time-variant voltage from a higher voltage level to a lower voltage level.
Figure 3:
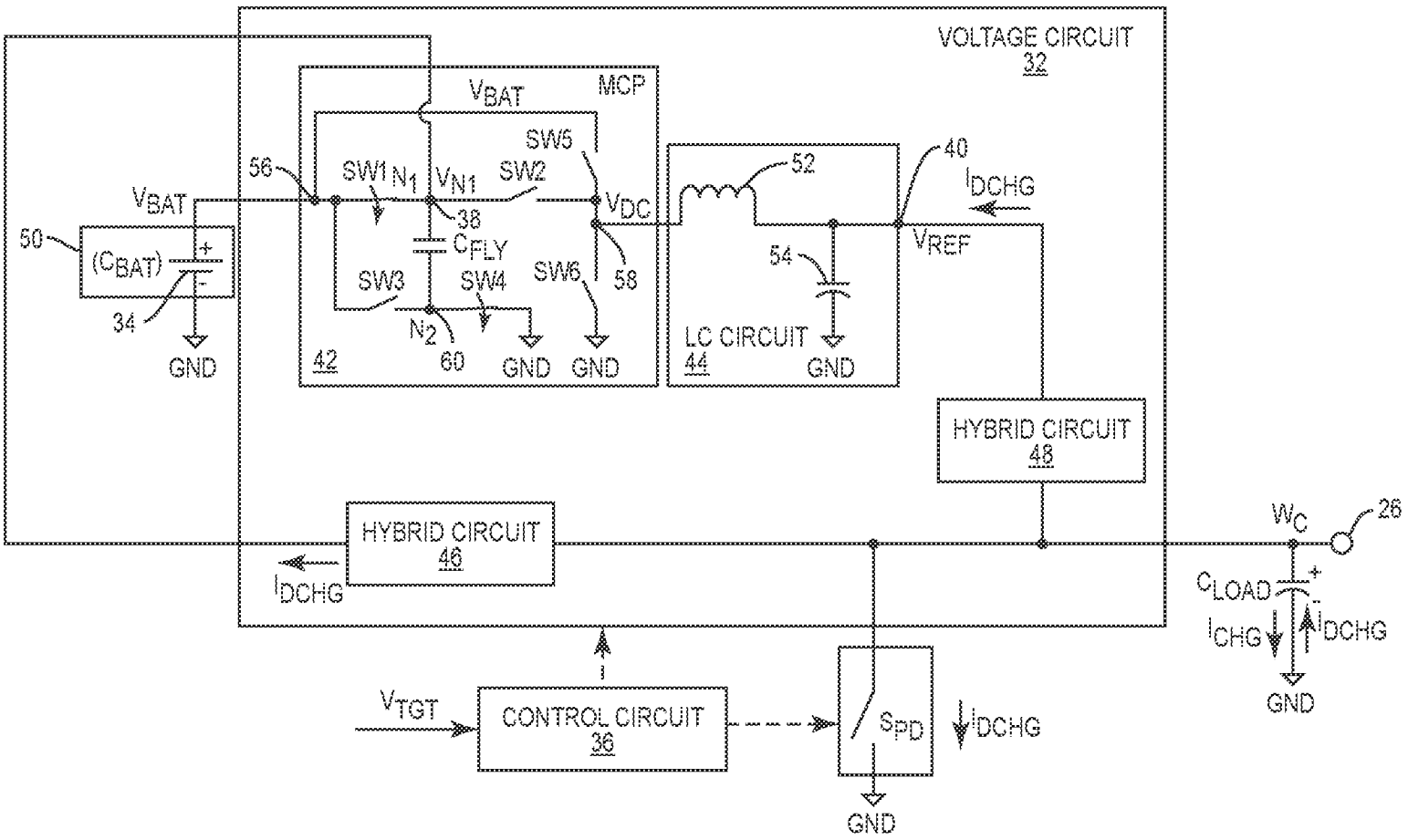
Figure 4B:
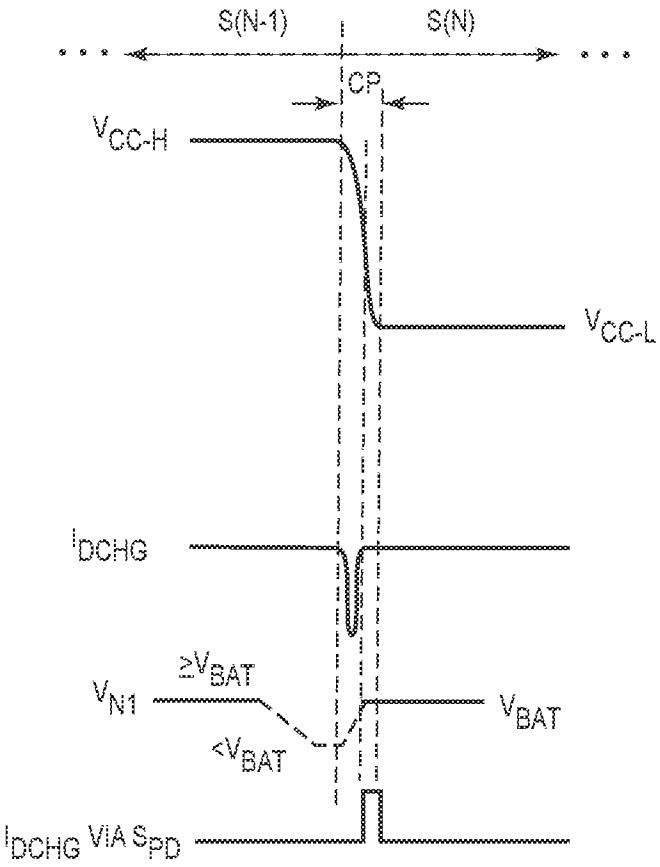
Figure 4A:
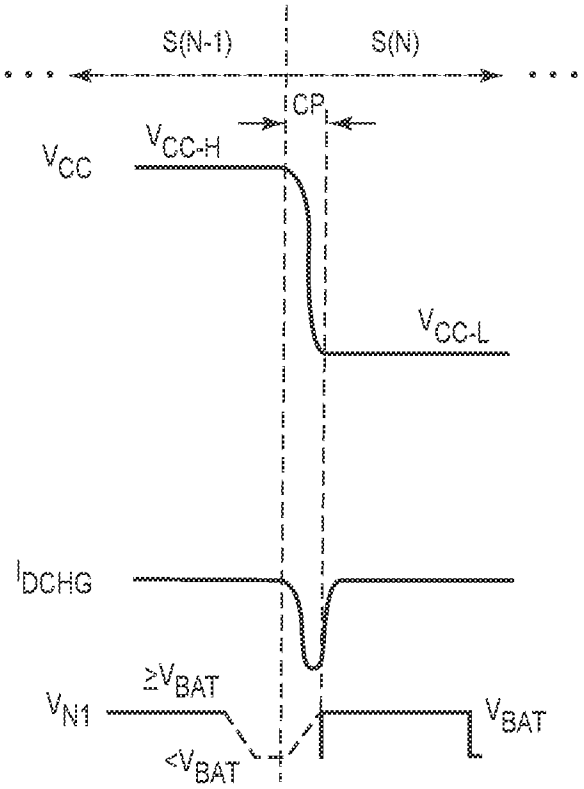

FIG. 3 is a schematic diagram providing exemplary illustrations of a voltage circuit in the power management circuit of FIG. 2 configured according to embodiments of the present disclosure to harvest energy when the time-variant voltage switches from the higher voltage level to the lower voltage level; and FIGS. 4A and 4B are graphic diagrams providing exemplary illustrations of the power management circuit of FIG. 2 configured to reduce energy loss when switching the time-variant voltage from the higher voltage level to the lower voltage level between adjacent orthogonal frequency division multiplexing (OFDM) symbols.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Embodiments of the disclosure relate to a power management circuit operable to reduce energy loss. The power management circuit is configured to provide a time-variant voltage(s) to a power amplifier(s) for amplifying an analog signal(s). To achieve the best possible operating efficiency at the power amplifier(s), the time-variant voltage(s) needs to rise and fall frequently and quickly in accordance with power fluctuations of the analog signal(s). The power management circuit stores an electrical potential energy (e.g., capacitive energy) when the time-variant voltage(s) increases and discharges the electrical potential energy when the time-variant voltage(s) decreases. In embodiments disclosed herein, the power management circuit is configured to harvest a portion of the discharged electrical potential energy to thereby charge a battery. By harvesting the discharged electrical potential energy, it is possible to prolong battery life concurrent to supporting fast and frequent voltage changes.

Figure 1:
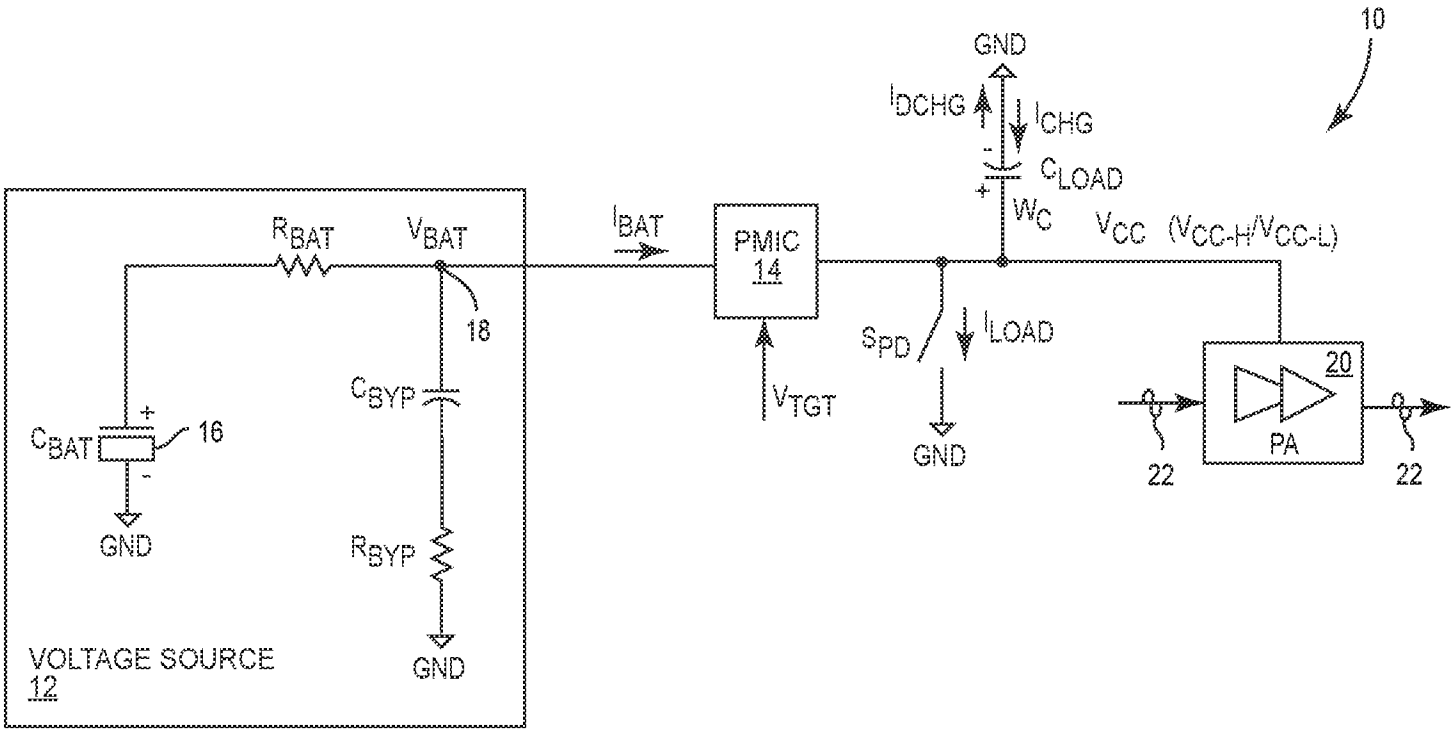
FIG. 1 (PRIOR ART)
FIG. 1 is a schematic diagram of an exemplary conventional power management circuit that may cause energy loss when switching a time-voltage $V_{CC}$ from a higher voltage level to a lower voltage level.

Before discussing the power management circuit operable to reduce energy loss according to the present disclosure, starting at FIG. 2, an overview of a conventional power management circuit that may cause energy loss is first provided with reference to FIG. 1.

FIG. 1 is a schematic diagram of an exemplary conventional power management circuit 10 that may cause energy loss when switching a time-voltage $V_{CC}$ from a higher voltage level $V_{CC\text{-}H}$ to a lower voltage level $V_{CC\text{-}L}$ ($V_{CC\text{-}H}>V_{CC\text{-}L}$). The conventional power management circuit 10 includes a voltage source 12 and a power management integrated circuit (PMIC) 14. The voltage source 12 includes a battery 16 (e.g., a Li-Ion battery) that supplies a battery voltage $V_{BAT}$ at a coupling node 18. The PMIC 14 is coupled to the coupling node 18 to receive the battery voltage $V_{BAT}$ and draw a battery current $I_{BAT}$. Accordingly, the PMIC 14 is configured to generate the time-variant voltage $V_{CC}$ based on the battery voltage $V_{BAT}$ and provide the time-variant voltage $V_{CC}$ to a power amplifier 20 for amplifying an analog signal 22.

The analog signal 22 may be modulated across a wide modulation bandwidth, which can cause a large current variation at the power amplifier 20. As such, it is necessary to present a low impedance to the power amplifier 20 to help reduce ripple in the time-variant voltage $V_{CC}$ caused by the current variation at the power amplifier 20. In this regard, the conventional power management circuit 10 typically includes a large capacitor $C_{LOAD}$ to help reduce the impedance seen by the power amplifier 20.

To avoid amplitude clipping to the analog signal 22 and improve efficiency of the power amplifier 20, the PMIC 14 is configured to generate the time-variant voltage $V_{CC}$ in accordance with a time-variant target voltage $V_{TGT}$ that tracks amplitude variations of the analog signal 22. In this regard, the time-variant voltage $V_{CC}$ can swing from the lower voltage level $V_{CC\text{-}L}$ to the higher voltage level $V_{CC\text{-}H}$, or vice versa, very rapidly and frequently. For example, the time-variant voltage $V_{CC}$ can increase or decrease from one orthogonal frequency division multiplexing (OFDM) symbol to another and must ramp up or down very quickly (e.g., ≤0.5 μs). When the time-variant voltage $V_{CC}$ increases from the lower voltage level $V_{CC\text{-}L}$ to the higher voltage level $V_{CC-H}$, the capacitor $C_{LOAD}$ stores an electrical potential energy $W_C$ (e.g., capacitive energy) by drawing a charge current $I_{CHG}$ from the voltage source 12. In contrast, when the time-variant voltage $V_{CC}$ decreases from the higher voltage level $V_{CC-H}$ to the lower voltage level $V_{CC-L}$, the capacitor $C_{LOAD}$ discharges the electrical potential energy $W_C$ by generating a discharge current $I_{DCHG}$ in a reverse direction opposite the charge current $I_{LOAD}$.

As shown in the equation (Eq. 1) below, an amount of the charge current $I_{CHG}$ and the discharge current $I_{DCHG}$ may depend on a capacitance of the capacitor $C_{LOAD}$ and a rate at which the time-variant voltage $V_{CC}$ changes.

$$I_{CHG}/I_{DCHG}=C_{LOAD}*dV_{CC}/dt) \quad \text{(Eq. 1)}$$

If the battery 16 is equated with a capacitor $C_{BAT}$ of infinite capacitance and is connected in parallel to the load capacitor $C_{LOAD}$, then a power loss $\Delta W$ associated with switching the time-variant voltage $V_{CC}$ from the higher voltage level $V_{CC-H}$ to the lower voltage level $V_{CC-L}$ can be expressed in equation (Eq. 2) below.

$$\begin{aligned}\Delta W &= 1/2C_{LOAD}*V_{CC-H}^2+1/2C_{BAT}*V_{CC-L}^2- \quad \text{(Eq. 2)}\\ &\quad 1/2(C_{LOAD}+C_{BAT})*V^2\\ &= 1/2[(C_{LOAD}*C_{BAT})/(C_{LOAD}+C_{BAT})]*\\ &\quad (V_{CC-H}-V_{CC-L})^2\\ V &= (C_{LOAD}*V_{CC-H}+C_{BAT}*V_{CC-L})/(C_{LOAD}+C_{BAT})\end{aligned}$$

Notably, the time-variant voltage $V_{CC}$ is required to increase or decrease very rapidly to keep up with power variations of the analog signal 22 and prevent amplitude clipping at the power amplifier 20. In this regard, a pulldown switch $S_{PD}$ is closed to shunt the discharge current $I_{DCHG}$ to a ground (GND) each time when the time-variant voltage $V_{CC}$ decreases from the higher voltage level $V_{CC-H}$ to the lower voltage level $V_{CC-L}$. As a result, all of the discharged electrical potential energy $\Delta W_C$ is lost. As such, it is desirable to harvest at least a portion of the electrical potential energy $\Delta W_C$ that is discharged each time when the time-variant voltage $V_{CC}$ switches from the higher voltage level $V_{CC-H}$ to the lower voltage level $V_{CC-L}$.

In this regard, FIG. 2 is a schematic diagram of an exemplary power management circuit 24 configured according to various embodiments of the present disclosure to reduce energy loss when switching a time-variant voltage $V_{CC}$ from a higher voltage level $V_{CC-H}$ to a lower voltage level $V_{CC-L}$. The power management circuit 24 includes a voltage output 26 that is coupled to a power amplifier 28. In examples disclosed herein, the voltage output 26 outputs the time-variant voltage $V_{CC}$ to the power amplifier 28 for amplifying an analog signal 30.

The analog signal 30 may be modulated with a wide modulation bandwidth (e.g., >200 MHz). In this regard, like the conventional power management circuit 10 of FIG. 1, a load capacitor $C_{LOAD}$ is employed to present a low impedance to the power amplifier 28 to help reduce ripples in the time-variant voltage $V_{CC}$. Similar to the large capacitor $C_{LOAD}$ in FIG. 1A, the load capacitor $C_{LOAD}$ will draw a charge current $I_{CHG}$ and store an electrical potential energy $W_C$ (e.g., capacitive energy) when the time-variant voltage $V_{CC}$ increases from the lower voltage level $V_{CC-L}$ to the higher voltage level $V_{CC-H}$. In contrast, the load capacitor $C_{LOAD}$ will generate a discharge current $I_{DCHG}$ in a reverse direction and discharges the electrical potential energy $W_C$ when the time-variant voltage $V_{CC}$ decreases from the higher voltage level $V_{CC-H}$ to the lower voltage level $V_{CC-L}$. The charge current $I_{CHG}$ and the discharge current $I_{DCHG}$ are determined by the equation (Eq.1) above. Similarly, a power loss $\Delta W$ associated with decreasing the time-variant voltage $V_{CC}$ from the higher voltage level $V_{CC-H}$ to the lower voltage level $V_{CC-L}$ can be determined by the equation (Eq.2) above.

In embodiments disclosed herein, the power management circuit 24 is configured to harvest at least a portion of the electrical potential energy $W_C$ discharged each time when the time-variant voltage $V_{CC}$ decreases from the higher voltage level $V_{CC-H}$ to the lower voltage level $V_{CC-L}$. As opposed to shunting the discharge current $I_{DCHG}$ entirely to a ground (GND) and losing all of the discharged electrical potential energy $W_C$, the power management circuit 24 is configured to drive at least a portion of the discharge current $I_{DCHG}$ toward a voltage circuit 32 to thereby charge a battery 34. By harvesting the electrical potential energy $W_C$ and charging the battery 34, it is possible to prolong battery life in an electronic device (e.g., smart phone) that relies on the battery 34 for operation.

The power management circuit 24 includes a control circuit 36, which can be a field-programmable gate array (FPGA), as an example. The control circuit 36 is configured to determine whether the time-variant voltage $V_{CC}$ will decrease from the higher voltage level $V_{CC-H}$ to the lower voltage level $V_{CC-L}$. The control circuit 36 may determine that the time-variant voltage $V_{CC}$ will decrease from the higher voltage level $V_{CC-H}$ to the lower voltage level $V_{CC-L}$ based on a time-variant target voltage $V_{TGT}$. For example, the time-variant target voltage $V_{TGT}$ can indicate to the control circuit 36 as to how the time-variant voltage $V_{CC}$ will change (increase or decrease) between a present time (e.g., a current OFDM symbol) and a future time (e.g., a next OFDM symbol). In response to determining that the time-variant voltage $V_{CC}$ will decrease from the higher voltage level $V_{CC-H}$ to the lower voltage level $V_{CC-L}$, the control circuit 36 may drive the discharge current $I_{DCHG}$ toward the voltage circuit 32 to thereby harvest the electrical potential energy We and charge the battery 34.

The voltage circuit 32 is configured to generate a first reference voltage $V_{N1}$ at a first reference node 38 and a second reference voltage $V_{REF}$ at a second reference node 40. In a non-limiting example, the voltage circuit 32 includes a multi-level charge pump 42, an inductor-capacitor (LC) circuit 44, a first hybrid circuit 46, and a second hybrid circuit 48.

The multi-level charge pump 42 is coupled to the battery 34 in a voltage source 50 to receive a battery voltage $V_{BAT}$ and a battery current $I_{BAT}$. The multi-level charge pump 42 is configured to generate the first reference voltage $V_{N1}$ and a low-frequency voltage $V_{DC}$ based on the battery voltage $V_{BAT}$. In a non-limiting example, the multi-level charge pump 42 can generate the low-frequency voltage $V_{DC}$ at multiple voltage levels in accordance with a selected duty cycle. In a non-limiting example, the multi-level charge pump 42 can operate in a buck mode to generate the low-frequency voltage $V_{DC}$ at or below the battery voltage $V_{BAT}$ ($V_{DC} \leq V_{BAT}$) or in a boost mode to generate the low-frequency voltage $V_{DC}$ at two times the battery voltage $V_{BAT}$ ($V_{DC}=2V_{BAT}$).

The LC circuit 44 includes a power inductor 52 and a bypass capacitor 54. The power inductor 52 is coupled between the multi-level charge pump 42 and the second reference node 40. The bypass capacitor 54 is coupled between the second reference node 40 and the GND. The LC circuit 44 is configured to function as a low-pass filter. Specifically, the power inductor 52 induces a respective low-frequency current IDC (e.g., a constant current) based on each of the multiple levels of the low-frequency voltage $V_{DC}$ to charge the bypass capacitor 54. Accordingly, the LC circuit 44 is configured to output the second reference voltage $V_{REF}$ at the second reference node 40 as an average of the multiple voltage levels of the low-frequency voltage $V_{DC}$. For example, if the multi-level charge pump 42 is configured to generate the low-frequency voltage $V_{DC}$ at 1 V for 70% of the time and at 5 V for 30% of the time, then the LC circuit 44 will output the second reference voltage $V_{REF}$ at 2.2 V (1 V*70%+5 V*30%).

The first hybrid circuit 46 is coupled between the first reference node 38 and the voltage output 26. The first hybrid circuit 46 can be configured to operate as a first closed switch, a first open switch, or a first low-dropout (LDO) regulator. When operating as the first closed switch, the first hybrid circuit 46 will pass the first reference voltage $V_{N1}$ to the voltage output 26. When operating as the first open switch, the first hybrid circuit 46 will block the first reference voltage $V_{N1}$ from the voltage output 26. When operating as the first LDO regulator, the first hybrid circuit 46 will regulate (e.g., reduce) the first reference voltage $V_{N1}$ at the voltage output 26.

The second hybrid circuit 48 is coupled between the second reference node 40 and the voltage output 26. The second hybrid circuit 48 can be configured to operate as a second closed switch, a second open switch, or a second LDO regulator. When operating as the second closed switch, the second hybrid circuit 48 will pass the second reference voltage $V_{REF}$ to the voltage output 26. When operating as the second open switch, the second hybrid circuit 48 will block the second reference voltage $V_{REF}$ from the voltage output 26. When operating as the second LDO regulator, the second hybrid circuit 48 will regulate (e.g., reduce) the second reference voltage $V_{REF}$ at the voltage output 26.

When the control circuit 36 determines (e.g., based on the time-variant target voltage $V_{TGT}$) that the time-variant voltage $V_{CC}$ is set to increase, the control circuit 36 can control the multi-level charge pump 42, the LC circuit 44, the first hybrid circuit 46, and/or the second hybrid circuit 48 to quickly ramp up the time-variant voltage $V_{CC}$ from the lower voltage level $V_{CC\text{-}L}$ (e.g., 1 V) to the higher voltage level $V_{CC\text{-}H}$ (e.g., 5 V). For a more detailed description on how the control circuit 36 can cause the power management circuit 24 to increase the time-variant voltage $V_{CC}$ within a defined temporal interval limit (e.g., <0.5 μs), please refer to U.S. patent application Ser. No. 17/217,654, entitled "POWER MANAGEMENT CIRCUIT FOR FAST AVERAGE POWER TRACKING VOLTAGE SWITCHING."

When the control circuit 36 determines that the time-variant voltage $V_{CC}$ is set to decrease from the higher voltage level $V_{CC\text{-}H}$ (e.g., 5 V) to the lower voltage level $V_{CC\text{-}L}$ (e.g., 1 V), the control circuit 36 can control the first hybrid circuit 46 and/or the second hybrid circuit 48 to drive the discharge current $I_{DCHG}$ toward the multi-level charge pump 42 and/or the LC circuit 44 to thereby harvest the electrical potential energy We discharged by the load capacitor $C_{LOAD}$.

In this regard, FIG. 3 is a schematic diagram providing exemplary illustrations of the voltage circuit 32 in the power management circuit 24 of FIG. 2 configured according to embodiments of the present disclosure to harvest energy when time-variant voltage $V_{CC}$ switches from the higher voltage level $V_{CC\text{-}H}$ to the lower voltage level $V_{CC\text{-}L}$. Common elements between FIGS. 2 and 3 are shown therein with common element numbers and will not be re-described herein.

The multi-level charge pump 42 includes an input node 56, an output node 58, the first reference node 38 (denoted as "N1"), and an intermediate node 60 (denoted as "N2"). Specifically, the input node 56 is coupled to the voltage source 50 to receive the battery voltage $V_{BAT}$, and the output node 58 is coupled to the LC circuit 44 to output the low-frequency voltage $V_{DC}$. The multi-level charge pump 42 includes a first switch SW1, a second switch SW2, a third switch SW3, a fourth switch SW4, a fifth switch SW5, and a sixth switch SW6. The first switch SW1 is coupled between the input node 56 and the first reference node 38. The second switch SW2 is coupled between the first reference node 38 and the output node 58. The third switch SW3 is coupled between the input node 56 and the intermediate node 60. The fourth switch SW4 is coupled between the intermediate node 60 and the GND. The fifth switch SW5 is coupled between the input node 56 and the output node 58. The sixth switch SW6 is coupled between the output node 58 and the GND. The multi-level charge pump 42 also includes a fly capacitor $C_{FLY}$ that is coupled between the first reference node 38 and the intermediate node 60.

To cause the voltage circuit 32 to harvest the electrical potential energy $W_C$, the control circuit 36 closes the first switch SW1 and the fourth switch SW4, while keeping all other switches open. The control circuit 36 further controls the first hybrid circuit 46 to operate as the first closed switch or the first LDO regulator to thereby drive a larger portion of the discharge current $I_{DCHG}$ toward the first reference node 38 to charge the fly capacitor $C_{FLY}$ and thereby store a larger portion of the discharged electrical potential energy $W_C$ in the battery 34. Concurrently, the control circuit 36 may also control the second hybrid circuit 48 to operate as the second closed switch or the second LDO regulator to drive a smaller portion of the discharge current $I_{DCHG}$ toward the LC circuit 44 to thereby store a smaller portion of the discharged electrical potential energy $W_C$ in the power inductor 52.

Notably, the control circuit 36 can only drive the discharge current $I_{DCHG}$ toward the first reference node 38 when the higher voltage level $V_{CC\text{-}H}$ is higher than the battery voltage $V_{BAT}$. If the higher voltage level $V_{CC\text{-}H}$ is lower than or equal to the battery voltage $V_{BAT}$, the control circuit 36 may not be able to drive the discharge current $I_{DCHG}$ toward the first reference node 38. Instead, the control circuit 36 may be forced to shunt the larger portion of the discharge current $I_{DCHG}$ to the GND by closing a pulldown switch $S_{PD}$. As a result, the larger portion of the discharged electrical potential energy $W_C$ may be lost. However, the control circuit 36 may still drive the smaller portion of the discharge current $I_{DCHG}$ toward the LC circuit 44 to thereby harvest the smaller portion of the discharged electrical potential energy $W_C$.

In the event that the lower voltage level $V_{CC\text{-}L}$ is also higher than the battery voltage $V_{BAT}$, the control circuit 36 may control the first hybrid circuit 46 and the second hybrid circuit 48 to continuously drive the discharge current $I_{DCHG}$ to the first reference node 38 and the second reference node 40 until the time-variant voltage $V_{CC}$ is reduced to the lower voltage level $V_{CC\text{-}L}$. As such, the control circuit 36 does not need to close the pulldown switch $S_{PD}$ to shunt the discharge current $I_{DCHG}$ to the GND.

In the event that the lower voltage level $V_{CC\text{-}L}$ is lower than the battery voltage $V_{BAT}$, the control circuit 36 may control the first hybrid circuit 46 and the second hybrid circuit 48 to drive the discharge current $I_{DCHG}$ to the first reference node 38 and the second reference node 40 until the time-variant voltage $V_{CC}$ is reduced to the lower voltage level $V_{CC-L}$. The control circuit 36 may then control the first hybrid circuit 46 to operate as the first open switch and close the pulldown switch $S_{PD}$ to shunt the remaining portion of the discharge current $I_{DCHG}$ to the GND. In the meantime, the control circuit 36 may control the second hybrid circuit 48 to operate as the second closed switch or the second LDO regulator to continue driving the discharge current $I_{DCHG}$ toward the second reference node 40 to thereby harvest the smaller portion of the discharged electrical potential energy $W_C$.

When driving the discharge current $I_{DCHG}$ concurrently toward the first reference node 38 and the second reference node 40, the control circuit 36 may control the first hybrid circuit 46 and the second hybrid circuit 48 to operate in same or different modes. In one example, the control circuit 36 can control the first hybrid circuit 46 to operate as the first closed switch and the second hybrid circuit 48 to operate as the second closed switch. In another example, the control circuit 36 can control the first hybrid circuit 46 to operate as the first closed switch and the second hybrid circuit 48 to operate as the second LDO regulator. In another example, the control circuit 36 can control the first hybrid circuit 46 to operate as the first LDO regulator and the second hybrid circuit 48 to operate as the second closed switch. In another example, the control circuit 36 can control the first hybrid circuit 46 to operate as the first LDO regulator and the second hybrid circuit 48 to operate as the second LDO regulator.

The power management circuit 24 of FIG. 2 may be configured to harvest the discharged electrical potential energy WC on a per-OFDM symbol basis. In this regard, FIGS. 4A and 4B are graphic diagrams providing exemplary illustrations of the power management circuit 24 of FIG. 2 configured to reduce energy loss when switching the time-variant voltage $V_{CC}$ from the higher voltage level $V_{CC-H}$ to the lower voltage level $V_{CC-L}$ between adjacent OFDM symbols.

For the convenience of illustration, FIGS. 4A and 4B each illustrates two adjacent OFDM symbols S(N−1) and S(N) among multiple OFDM symbols. The OFDM symbol S(N−1) proceeds immediately to the OFDM symbol S(N) and is referred to as a first one of the multiple OFDM symbols. The OFDM symbol S(N) succeeds immediately to the OFDM symbol S(N−1) and is referred to as a second one of the multiple OFDM symbols.

With reference to FIG. 4A, during the OFDM symbol S(N−1), the time-variant voltage $V_{CC}$ is at the higher voltage level $V_{CC-H}$ and the first reference voltage $V_{N1}$ may have gone from being greater than or equal to the battery voltage $V_{BAT}$ to below the battery voltage $V_{BAT}$ as the fly capacitor $C_{FLY}$ in the multi-level charge pump 42 is discharged. Prior to the OFDM symbol S(N), the control circuit 36 determines (e.g., based on the time-variant target voltage $V_{TGT}$) that the time-variant voltage $V_{CC}$ will change from the higher voltage level $V_{CC-H}$ to the lower voltage level $V_{CC-L}$ and the lower voltage level $V_{CC-L}$ is higher than the battery voltage $V_{BAT}$. Accordingly, during a cyclic prefix (CP) of the symbol S(N), the control circuit 36 controls the first hybrid circuit 46 to drive the discharge current $I_{DCHG}$ toward the first reference node 38 to thereby charge the fly capacitor $C_{FLY}$ and raise the first reference voltage $V_{N1}$ to the battery voltage $V_{BAT}$. Given that the lower voltage level $V_{CC-L}$ is higher than the battery voltage $V_{BAT}$, the control circuit 36 will not close the pulldown switch $S_{PD}$.

For example, if the higher voltage level $V_{CC-H}$ is 4.8 V, the lower voltage level $V_{CC-L}$ is 4 V, the battery voltage $V_{BAT}$ is 3.8 V, and the load capacitor $C_{LOAD}$ is 2.2 μF, then the electrical potential energy $W_C$ in the symbols S(N−1) and S(N) can be expressed as follows:

$$W_C \text{ in } S(N-1)=\tfrac{1}{2}C_{LOAD}*V_{CC-H}^2=\tfrac{1}{2}*2.2*4.8^2=25.34\ \mu J$$

$$W_C \text{ in } S(N)=\tfrac{1}{2}C_{LOAD}*V_{CC-L}^2=\tfrac{1}{2}*2.2*4.0^2=17.60\ \mu J$$

Accordingly, the $\Delta W_C$ between S(N−1) and S(N) will be 7.74 μJ (25.34 μJ−17.60 μJ) and change in charge ΔQ on the load capacitor $C_{LOAD}$ will be 1.76 μC ($\Delta Q=C_{LOAD}*(V_{CC-H}-V_{CC-L})$=1.76 μC). Thus, by driving the discharge current $I_{DCHG}$ toward the first reference node 38 to thereby raise the first reference voltage $V_{N1}$ to the battery voltage $V_{BAT}$, it is possible to harvest approximately 6.69 μJ ($V_{BAT}*\Delta Q$=3.8*1.76=6.69 μJ), which amounts to approximately 86% of the discharged electrical potential energy $W_C$.

With reference to FIG. 4B, during the OFDM symbol (N−1), the time-variant voltage $V_{CC}$ is at the higher voltage level $V_{CC-H}$ and the first reference voltage $V_{N1}$ may have gone from being greater than or equal to the batter voltage $V_{BAT}$ to below the battery voltage $V_{BAT}$ as the fly capacitor $C_{FLY}$ in the multi-level charge pump 42 is discharged. Prior to the OFDM symbol S(N), the control circuit 36 determines (e.g., based on the time-variant target voltage $V_{TGT}$) that the time-variant voltage $V_{CC}$ will change from the higher voltage level $V_{CC-H}$ to the lower voltage level $V_{CC-L}$ and the lower voltage level $V_{CC-L}$ is lower than the battery voltage $V_{BAT}$. Accordingly, during a cyclic prefix (CP) of the symbol S(N), the control circuit 36 controls the first hybrid circuit 46 to drive the discharge current $I_{DCHG}$ toward the first reference node 38 to thereby charge the fly capacitor $C_{FLY}$ and raise the first reference voltage $V_{N1}$ to the battery voltage $V_{BAT}$. Given that the lower voltage level $V_{CC-L}$ is lower than the battery voltage $V_{BAT}$, the control circuit 36 will close the pulldown switch $S_{PD}$ to shunt the remainder of the discharge current $I_{DCHG}$ to the GND.

For example, if the higher voltage level $V_{CC-H}$ is 4.8 V, the lower voltage level $V_{CC-L}$ is 2.8 V, the battery voltage $V_{BAT}$ is 3.8 V, and the load capacitor $C_{LOAD}$ is 2.2 μF, then the electrical potential energy $W_C$ in the symbols S(N−1) and S(N) can be expressed as follows:

$$W_C \text{ in } S(N-1)=\tfrac{1}{2}C_{LOAD}*V_{CC-H}^2=\tfrac{1}{2}*2.2*4.8^2=25.34\ \mu J$$

$$W_C@V_{BAT}=\tfrac{1}{2}C_{LOAD}*V_{BAT}^2=\tfrac{1}{2}*2.2*3.8^2=15.88\ \mu J$$

$$W_C \text{ in } S(N)=\tfrac{1}{2}C_{LOAD}*V_{CC-L}^2=\tfrac{1}{2}*2.2*2.8^2=8.62\ \mu J$$

Accordingly, the $\Delta W_C$ between the $W_C$ in the symbol S(N−1) and the $W_C$ @ $V_{BAT}$ will be 9.46 μJ (25.34 μJ−15.88 μJ) and the $\Delta W_C$ between the $W_C$ @ $V_{BAT}$ and in the symbol S(N) will be 7.26 μJ (15.88 μJ −8.26 μJ). A total change in charge ΔQ on the load capacitor $C_{LOAD}$ will be 1.76 μC ($\Delta Q=C_{LOAD}*(V_{CC-H}-V_{CC-L})$=16.72 μC). The ΔQ between the symbol S(N−1) and $W_C$ @ $V_{BAT}$ will be 2.2 μC (2.2 μF*(4.8 V−3.8 V)=2.2 μC). The ΔQ between $W_C$ @ $V_{BAT}$ and the symbol S(N) will also be 2.2 μC (2.2 μF*(3.8 V−2.8 V)=2.2 μC). Thus, by driving the discharge current $I_{DCHG}$ toward the first reference node 38 to thereby raise the first reference voltage $V_{N1}$ to the battery voltage $V_{BAT}$, it is possible to harvest approximately 6.69 μJ ($V_{BAT}*\Delta Q$=3.8*2.2=8.36 μJ), which amounts to approximately 50% of the discharged electrical potential energy $W_C$.

Those skilled in the art will recognize improvements and modifications to the preferred embodiments of the present disclosure. All such improvements and modifications are considered within the scope of the concepts disclosed herein and the claims that follow.

What is claimed is:

1. A power management circuit comprising:

a voltage circuit configured to generate a time-variant voltage at a voltage output based on a battery voltage; and a control circuit configured to:

determine that the time-variant voltage will decrease from a higher voltage level to a lower voltage level;

cause the voltage circuit to harvest an electrical potential energy discharged when the higher voltage level and the lower voltage level are higher than the battery voltage;

and cause the voltage circuit to shunt the electrical potential energy to a ground when the higher voltage level is lower than or equal to the battery voltage.

2. The power management circuit of claim 1 wherein, when the higher voltage level and the lower voltage level are higher than the battery voltage, the control circuit is further configured to direct a discharge current generated when the time-variant voltage decreases from the higher voltage level to the lower voltage level toward the voltage circuit to thereby cause the voltage circuit to harvest the electrical potential energy.

3. The power management circuit of claim 2 further comprising a load capacitor coupled between the voltage output and the ground and configured to:

draw a charge current to store the electrical potential energy when the time-variant voltage increases from the lower voltage level to the higher voltage level; and generate the discharge current to discharge the electrical potential energy when the time-variant voltage decreases from the higher voltage level to the lower voltage level.

4. The power management circuit of claim 2 wherein the voltage circuit comprises:

a multi-level charge pump comprising a fly capacitor and configured to:

generate a first reference voltage at a first reference node based on the battery voltage; and generate a low-frequency voltage at an output node based on the battery voltage and in accordance with a selected duty cycle; and an inductor-capacitor (LC) circuit comprising a power inductor and configured to average the low-frequency voltage to generate a second reference voltage at a second reference node.

5. The power management circuit of claim 4 wherein the control circuit is further configured to direct the discharge current toward the first reference node to store a larger portion of the discharged electrical potential energy in the fly capacitor.

6. The power management circuit of claim 5 wherein the control circuit is further configured to direct the discharge current toward the second reference node to harvest a smaller portion of the discharged electrical potential energy in the power inductor.

7. The power management circuit of claim 5 wherein the multi-level charge pump comprises:

an input node coupled to a voltage source to receive the battery voltage;

the output node coupled to the LC circuit to output the low-frequency voltage to the LC circuit;

a first switch coupled between the input node and the first reference node;

a second switch coupled between the first reference node and the output node;

a third switch coupled between the input node and an intermediate node;

a fourth switch coupled between the intermediate node and the ground;

a fifth switch coupled between the input node and the output node;

a sixth switch coupled between the second reference node and the ground; and the fly capacitor coupled between the first reference node and the intermediate node.

8. The power management circuit of claim 7 wherein the control circuit is further configured to close the first switch and the second switch to direct the larger portion of the discharge current toward the first reference node to thereby store the larger portion of the discharged electrical potential energy in the fly capacitor.

9. The power management circuit of claim 5 wherein the voltage circuit further comprises:

a first hybrid circuit coupled between the first reference node and the voltage output and configured to:

operate as a first closed switch to pass the first reference voltage to the voltage output;

operate as a first open switch to block the first reference voltage from the voltage output; and operate as a first low-dropout (LDO) regulator to regulate the first reference voltage at the voltage output; and a second hybrid circuit coupled between the second reference node and the voltage output and configured to:

operate as a second closed switch to pass the second reference voltage to the voltage output;

operate as a second open switch to block the second reference voltage from the voltage output; and operate as a second LDO regulator to regulate the second reference voltage at the voltage output.

10. The power management circuit of claim 9 wherein the control circuit is further configured to:

configure the first hybrid circuit to operate as the first closed switch to pass the discharge current to the first reference node; and configure the second hybrid circuit to operate as the second closed switch to pass the discharge current to the second reference node.

11. The power management circuit of claim 9 wherein the control circuit is further configured to:

configure the first hybrid circuit to operate as the first LDO regulator to regulate the discharge current at the first reference node; and configure the second hybrid circuit to operate as the second LDO regulator to regulate the discharge current at the second reference node.

12. The power management circuit of claim 9 wherein the control circuit is further configured to:

configure the first hybrid circuit to operate as the first closed switch to pass the discharge current to the first reference node; and configure the second hybrid circuit to operate as the second LDO regulator to regulate the discharge current at the second reference node.

13. The power management circuit of claim 9 wherein the control circuit is further configured to:

configure the first hybrid circuit to operate as the first LDO regulator to regulate the discharge current at the first reference node; and configure the second hybrid circuit to operate as the second closed switch to pass the discharge current to the second reference node.

14. The power management circuit of claim 9 wherein the control circuit is further configured to configure the first hybrid circuit to operate as the first open switch in response to the time-variant voltage being decreased from the higher voltage level to the battery voltage.

15. The power management circuit of claim 14 wherein the control circuit is further configured to continue to shunt the discharge current to the ground in response to the lower voltage level being lower than the battery voltage.

16. The power management circuit of claim 15 further comprising a pulldown switch coupled between the voltage output and the ground, wherein the control circuit is further configured to close the pulldown switch to shunt the discharge current to the ground.

17. The power management circuit of claim 1 wherein:

the voltage circuit is further configured to:

generate the time-variant voltage at the higher voltage level in a first one of a plurality of orthogonal frequency division multiplexing (OFDM) symbols; and generate the time-variant voltage at the lower voltage level in a second one of the plurality of OFDM symbols immediately succeeding the first one of the plurality of OFDM symbols; and the control circuit is further configured to cause the voltage circuit to harvest the electrical potential energy discharged during the second one of the plurality of OFDM symbols.

18. The power management circuit of claim 17 wherein the control circuit is further configured to cause the voltage circuit to harvest the electrical potential energy discharged during the second one of the plurality of OFDM symbols in response to the higher voltage level in the first one of the plurality of OFDM symbols being higher than the battery voltage.

19. The power management circuit of claim 17 wherein the control circuit is further configured to shunt the electrical potential energy discharged during the second one of the plurality of OFDM symbols to the ground in response to the higher voltage level in the first one of the plurality of OFDM symbols being lower than or equal to the battery voltage.

* * * * *